US005980266A

United States Patent [19]

Hsu

[11] Patent Number: 5,980,266

[45] **Date of Patent: *Nov. 9, 1999**

[54] CONDUCTIVE STRAP DEVICE FOR PROVIDING DUAL ELECTRICAL PATHS

[76] Inventor: Shih-Min Hsu, 4F, 9 Lane 94, Tsao-Ti-Wei, Shen-Keng Country, Taipei Hsien, Taiwan

[ * ] Notice: This patent issued on a continued prosecution application filed under 37 CFR 1.53(d), and is subject to the twenty year patent term provisions of 35 U.S.C. 154(a)(2).

[21] Appl. No.: 08/850,067

[22] Filed: May 2, 1997

[51] Int. Cl.[6] ..... H01R 33/00

[52] U.S. Cl. ..... 439/37; 439/700

[58] Field of Search ..... 439/37, 675, 700, 439/824, 63, 92, 21

[56] References Cited

U.S. PATENT DOCUMENTS 5,004,425 4/1991 Hee ..... 439/92
5,018,044 5/1991 Weiss ..... 439/37
5,067,906 11/1991 Woodgate ..... 439/675
5,677,822 10/1997 Cohen et al. .
5,746,606 5/1998 Sobhani ..... 439/21

FOREIGN PATENT DOCUMENTS 2243034A 10/1991 United Kingdom ..... 439/700

*Primary Examiner*—Neil Abrams
*Assistant Examiner*—Javaid Nasri
*Attorney, Agent, or Firm*—Finnegan, Henderson, Farabow, Garrett and Dunner, L.L.P.

[57] ABSTRACT

A conductive strap device for establishing dual electrical paths with a person's body includes a coaxial fastener structure having a spring-loaded contact pin to provide a first electrical path and a conductive member arranged coaxially with and electrically insulated from the contact pin to provide a second electrical path.

14 Claims, 4 Drawing Sheets

CONDUCTIVE STRAP DEVICE FOR PROVIDING DUAL ELECTRICAL PATHS

BACKGROUND OF THE INVENTION

The present invention relates to a fastener structure and, in particular, to an improved fastener structure for providing dual electrical circuit paths.

FIG. 1 shows a structure of a conventional fastener capable of providing dual electrical loops when used in an anti-static electrically conductive strap. In such a conventional fastener structure, a male fastening part 1' is provided on an antistatic belt, which is comprised of a pair of coaxial conductive elements 11' and 12', separated by an insulating washer 13' therebetween, such that when fitted into a female fastening part 2' to form an electrical circuit, two independent closed circuits are established. The female fastening part 2' is provided on a cable, wherein a pair of conductive elements 21' and 22' are separated by an insulating washer 23'. When the male and female fastening parts are fitted together, the conductive elements 21' and 22' come into contact with conductive elements 11' and 12' of the male fastening part, respectively, to form two circuits.

Conventionally, the conductive element 11' of the male fastening part 1' is in the shape of a circular plate and the conductive element 21' of the female fastener is a spring. When the male and female fastening parts 1' and 2' are fitted together, contact with the conductive element 21' is made by the resiliency of the spring and the conductive element 11' to provide one closed electrical circuit. However, in the above structure, poor conductivity may arise due to insufficient contact between the male and female fastening parts because the spring may become deformed or damaged by external forces, thus damaging female fastening part 2', and increasing cost of the product (such as the cable) having the female fastening part.

SUMMARY OF THE PRESENT INVENTION

In view of the above and other disadvantages, an object of the present invention is to provide an improved fastener structure which changes the manner in which the male and female fastening parts are fitted. Specifically, a conductive plate is used instead of the conventional spring structure such that the problem of poor contact is solved.

Another object of the present invention is to provide a fastener structure which prolongs the lifetime of the cable, thus reducing the cost of the applied apparatus.

BRIEF DESCRIPTION OF THE DRAWINGS

These and other objects and advantages of the present invention will become apparent from the following detailed description of a preferred embodiment thereof in conjunction with the accompanying drawings, in which.

DETAILED DESCRIPTION OF THE PREFERRED EMBODIMENT

Figure 2:
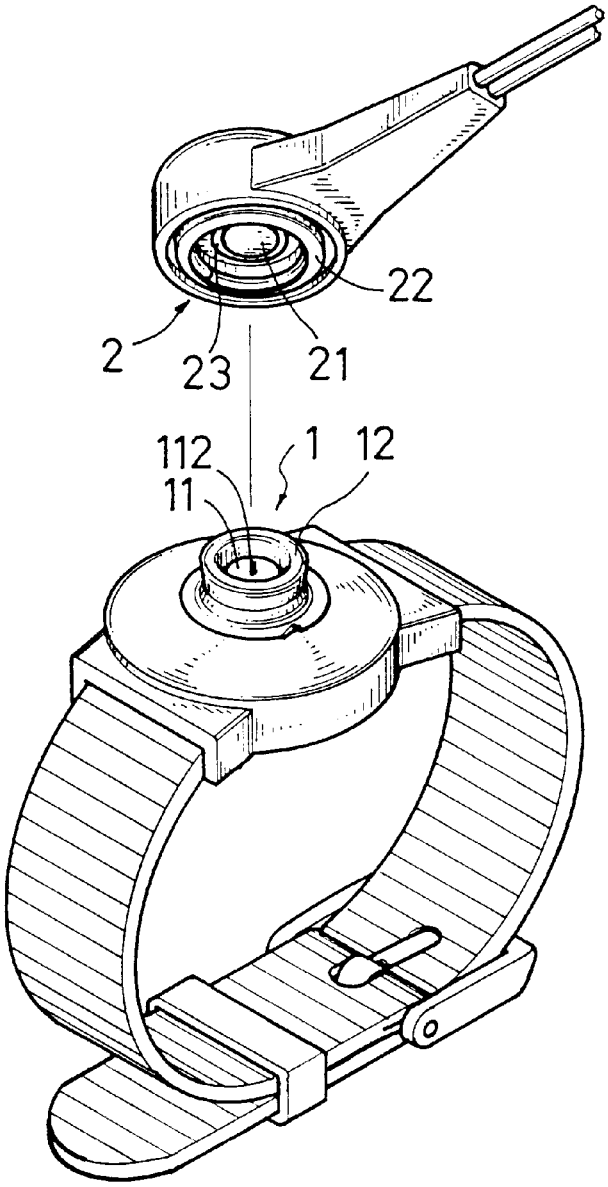
FIG. 2 shows a perspective view of a dual loop fastener structure of the present invention which is also embodied in an anti-static electrically conductive strap.

FIG. 2 represents a perspective view of a fastener structure of the present invention as used in a dual loop anti-static electrically conductive strap. According to the present invention, a point contact is provided to overcome the possibility of short circuit that may occur in conventional fasteners due to uneven forces acted upon a spring which provides a contact surface. In the structure of a female fastening part 2 in accordance with the present invention, conventional spring element 21' is replaced by a first section of conductive material in the shape of a flat conductive plate 21. The male fastening part 1 comprises a flat conductive plate 11 with a pin 112, which is spring loaded, extending therefrom for making contact with the flat conductive plate 21 of the female fastening part 2. The pin 112 and flat conductive plate 21 are both made of a rigid material and make a point contact with each other such that the structure after contact is not subject to uneven forces and that the female fastening part 2 is not easily deformable, thus increasing the lifetime thereof.

Figure 3:
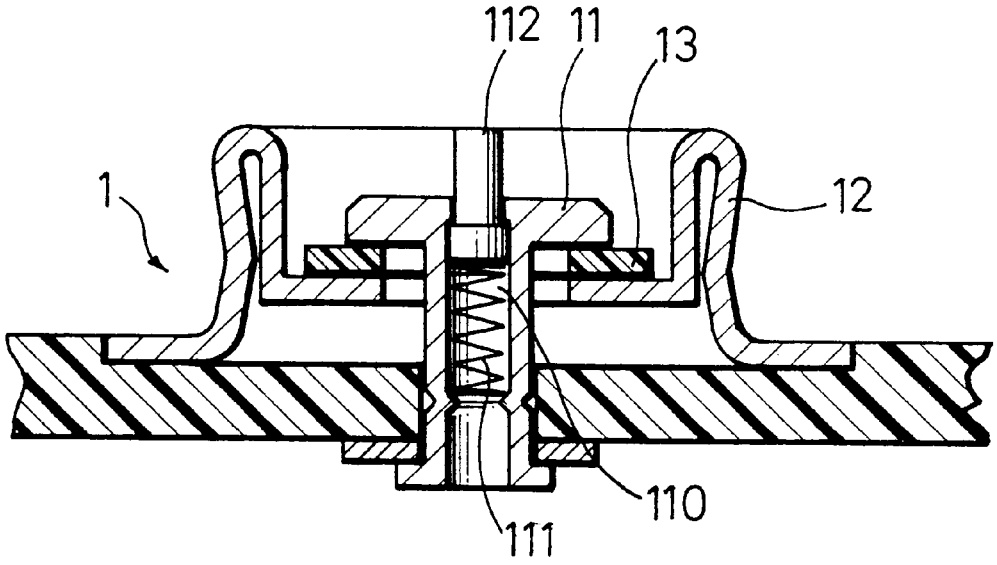
FIG. 3 shows a cross sectional view of a male fastening part of a dual loop fastener structure of the present invention.
Figure 4:
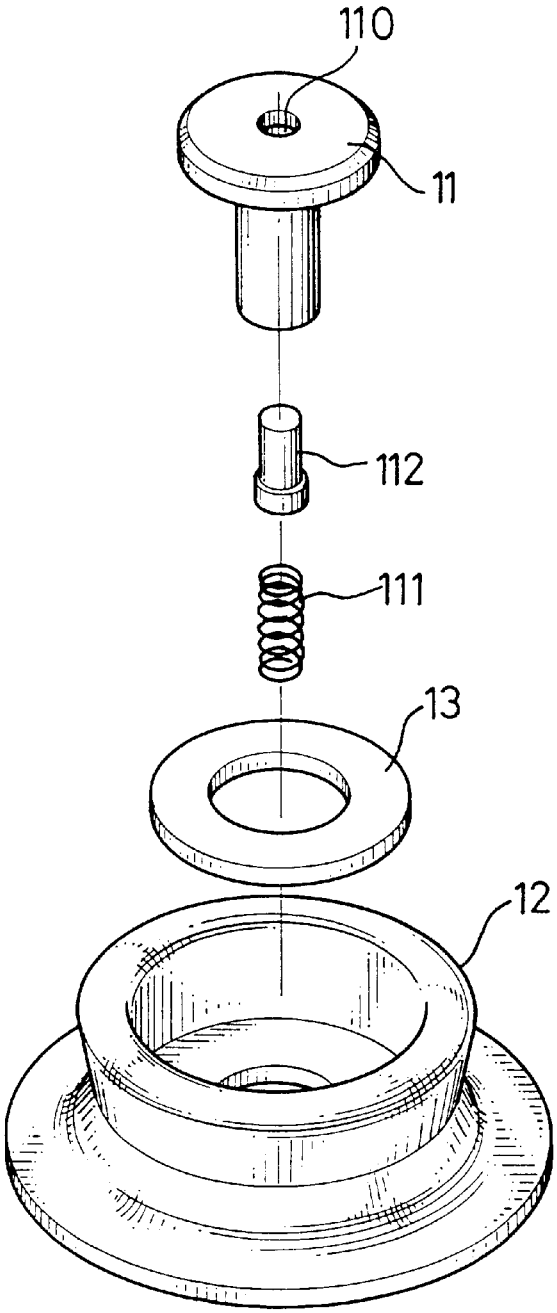
FIG. 4 shows a perspective exploded view of a male fastening part of the dual loop fastener structure of the present invention.

The structure of the male fastening part 1 of the present invention will now be described in greater detail with reference to FIGS. 3 and 4. As shown in the drawings, the conductive element 11 is a hollow post shaped structure having a flat top. In order to provide the point contact, the conductive element 11 is provided thereon with a through hole 110 and a pin 112 fitted with a spring 111 disposed in the hollow structure of the conductive element 11. The pin 112 projects from the through hole 110 and moves up and down by the resiliency of the spring 111. In addition, the spring 111 and the pin 112 are placed in the conductive element 11 and are tightly clamped at a proper position on the conductive element 11 by means of a clamping tool such that the spring 111 and the pin 112 will not fall off from the conductive element 11 and that a suitable space for movement is maintained. An insulating washer 13 is fitted under the conductive element 11 thus obtained, which is then fitted into another conductive element 12 by means of stamping or using rivets.

As noted above, the conductive elements 11 and 12 are separated by the insulating washer 13 such that two independent electrical paths are provided when the male fastening part 1 is engaged with the female fastening part 2. Similarly, the first section of conductive material 21 is insulated from the second section of conductive material 22 by another insulating washer 23. In addition, according to the present invention, as a flat conductive plate 21 is used instead of the conventional spring 21' in the female fastener on the cable, the contact force of the plate 21 with the pin 112 is more even, thereby a good electrical connection of the male and female fastening parts is obtained. The spring 111, disposed inside the male fastening part, causes the pin 112 to provide a point contact with the conductive element 21 of the female fastening part 2.

Moreover, the pin 112 is made of a rigid material capable of better bearing the pressure applied by the female fastening part, thus preventing the pin from being subjected to uneven forces.

The above described spring loaded contact pin structure may be embodied in either an electrically conductive strap, as shown in FIG. 2, or an electrically conductive cord that connects to the conductive strap.

Figure 1:
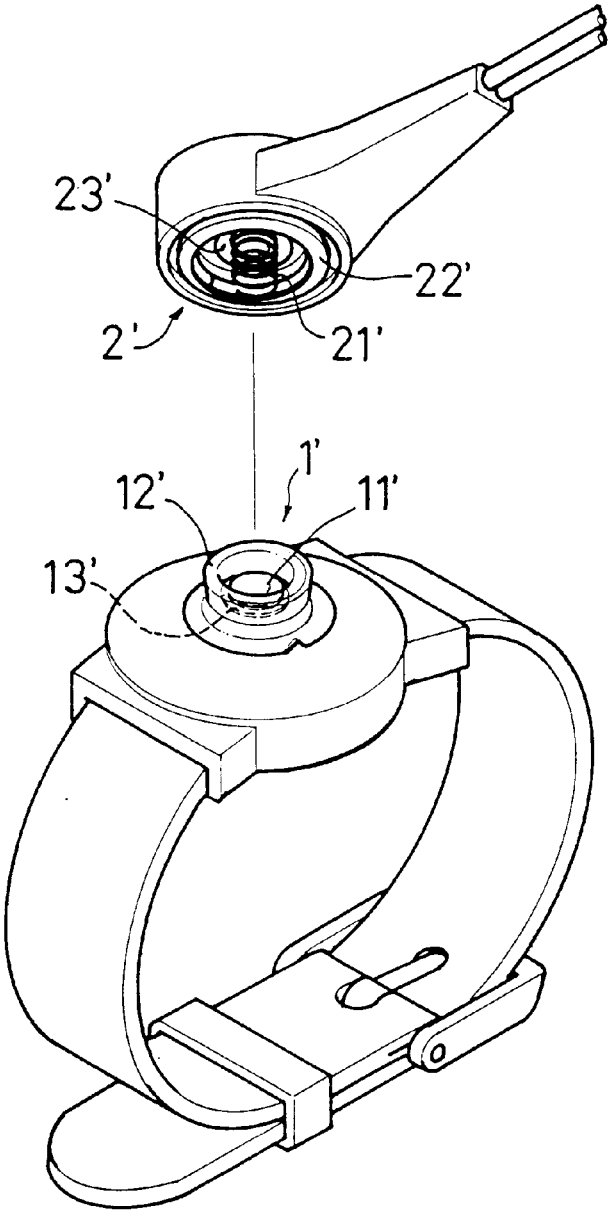
FIG. 1 ( PRIOR ART )
FIG. 1 shows a conventional dual loop fastener structure which is embodied in an anti-static electrically conductive strap.

Furthermore, according to the principle of the present invention, incidents of damage occurred to the fastener are considerably reduced than that of the conventional structure (as shown in FIG. 1) such that when used for connection, in particular, to a cable, the lifetime of the cable can be effectively prolonged.

From the foregoing, the structure of the present invention can effectively improve the disadvantage of poor contact as occurred in the conventional fastener structure. However, the above embodiment has been given for describing the principle of the present invention and should not be construed in a limiting sense. The scope of the present invention is limited only by the appended claims.

I claim:

1. A conductive strap for establishing two electrical paths with a person's body, comprising:

a first section of conductive material;

a second section of conductive material;

a section of insulating material insulating said first section of conductive material from said second section of conductive material;

a first conductive element having a flat top portion and for contacting said first section of conductive material, comprising contact means for establishing an electrical path and protruding from said top portion, said contact means being rigid, and resilient means for providing resiliency to said contact means and for supporting said contact means to protrude from said top portion;

a second conductive element arranged coaxially with said first conductive element; and insulating means disposed between said first conductive element and said second conductive element for electrically insulating said first conductive element from said second conductive element, wherein said contact means and said second conductive element create a substantially even contact surface.

2. The strap device as claimed in claim 1 wherein said contact means comprises a pin.

3. The strap device as claimed in claim 1 wherein said resilient means comprises a spring.

4. The strap device as claimed in claim 1 wherein said second section of conductive material is placeable in electrical contact with said second conductive element; and is electrically insulated from said first conductive element; said insulation being provided by said section of insulating material.

5. A conductive strap for establishing two electrical paths with a person's body, comprising:

a first section of conductive material for establishing a first electrical path;

a second section of conductive material for establishing a second electrical path;

a first conductive element having a top portion and for contacting said first section of conductive material, comprising a pin protruding from said top portion and being electrically connected to said first section of conductive material, and a spring for supporting said pin for protruding from said top portion;

a second conductive element arranged coaxially with said first conductive element and placeable in electrical contact with said second section of conductive material, and insulating means disposed between said first conductive element and said second conductive element for electrically insulating said first conductive element and said second conductive element, wherein said pin and said second conductive element create a substantially even contact surface.

6. A device for providing dual electrical paths with a person's body, comprising:

an electrically conductive strap adapted to be worn on a person's body, including a first section of conductive material, a second section of conductive material, and a section of insulating material insulating said first section of conductive material from said second section of conductive material; and an electrically conductive cord capable of establishing two electrical paths, including a first conductive element having a top portion and for contacting said first section of conductive material, comprising contact means for establishing an electrical path and protruding from said top portion, said contact means being rigid; and resilient means for providing resiliency to said contact means and for supporting said contact means to protrude from said top portion;

a second conductive element arranged coaxially with said first conductive element, and insulating means disposed between said first conductive element and said second conductive element for electrically insulating said first conductive element from said second conductive element.

7. The device as claimed in claim 6 wherein said contact means comprises a pin.

8. The device as claimed in claim 6 wherein said resilient means comprises a spring.

9. The device as claimed in claim 6 wherein said second section of conductive material is placeable in electrical contact with said second conductive element, and is electrically insulated from said first conductive element, said insulation being provided by said section of insulating material.

10. A device for providing dual electrical paths with a person's body, comprising:

an electrically conductive strap adapted to be worn on a person's body, including a first section of conductive material, a second section of conductive material, and a section of insulating material insulating said first section of conductive material from said second section of conductive material; and an electrically conductive cord capable of establishing two electrical paths, including a first conductive element having a top portion and for contacting said first section of conductive material, comprising a pin for establishing an electrical path and protruding from said top portion, and a spring for providing resiliency to said pin and for supporting said pin to protrude from said top portion;

a second conductive element arranged coaxially with said first conductive element, and an insulating washer disposed between said first conductive element and said second conductive element for electrically insulating said first conductive element from said second conductive element.

11. A connector device for establishing two electrical paths, comprising:

a first conductive element including a hollow post and a top portion;

a pin disposed inside said hollow post and protruding from said top portion of said first conductive element;

a spring disposed inside said hollow post and contiguous with said pin for providing resiliency to axial movement of said pin and for supporting said pin to protrude from said top portion;

a second conductive element arranged coaxially with said first conductive element; and an insulating washer disposed between said first conductive element and said second conductive element for electrically insulating said first conductive element from said second conductive element;

wherein said hollow post is secured at a position to keep said pin and said spring within said hollow post and to constrain said pin and said spring.

12. The device as claimed in claim 11 wherein said top portion is substantially flat.

13. The device as claimed in claim 11 wherein said hollow post is clamped to keep said pin and said spring within said hollow post and to constrain said pin and said spring.

14. The device as claimed in claim 11 wherein said pin and said second conductive element create a substantially even contact surface.

* * * * *